US009051837B2

(12) United States Patent
Chiu et al.

(10) Patent No.: US 9,051,837 B2
(45) Date of Patent: Jun. 9, 2015

(54) IMPELLER

(75) Inventors: Chun-Lung Chiu, Taoyuan Hsien (TW); Hsiang-Jung Huang, Taoyuan Hsien (TW); Hsin-Chen Lin, Taoyuan Hsien (TW); Chih-Hui Wu, Taoyuan Hsien (TW); Bao-Hong Tong, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 562 days.

(21) Appl. No.: 13/435,911

(22) Filed: Mar. 30, 2012

(65) Prior Publication Data

US 2012/0251323 A1 Oct. 4, 2012

(30) Foreign Application Priority Data

Apr. 1, 2011 (TW) ..... 100205780 U

(51) Int. Cl.
*F01D 5/14* (2006.01)
*F01D 5/02* (2006.01)
*F04D 29/18* (2006.01)

(52) U.S. Cl.
CPC .. *F01D 5/02* (2013.01); *F01D 5/14* (2013.01); *F04D 29/188* (2013.01); *F05D 2260/96* (2013.01); *F05D 2210/33* (2013.01)

(58) Field of Classification Search
CPC ..... F01D 5/02; F01D 5/14; F04D 29/188; F05D 2210/33; F05D 2260/96
USPC ..... 415/55.1–55.7, 98, 119; 416/175, 182, 416/193 R, 198 R, 200 R, 201 R, 201 A, 203, 416/223 R
See application file for complete search history.

(56) References Cited

U.S. PATENT DOCUMENTS

| | | | | |
|---|---|---|---|---|
| 4,204,802 | A * | 5/1980 | Schonwald et al. | 415/55.1 |
| 5,209,630 | A * | 5/1993 | Roth | 415/55.1 |
| 6,179,561 | B1 * | 1/2001 | Horng | 415/208.3 |
| 6,296,439 | B1 * | 10/2001 | Yu et al. | 415/55.1 |
| 6,322,319 | B1 * | 11/2001 | Yoshioka | 415/55.1 |
| 6,514,036 | B2 * | 2/2003 | Marshall et al. | 415/98 |
| 6,986,643 | B2 * | 1/2006 | Huang et al. | 416/183 |
| 7,210,907 | B2 * | 5/2007 | Patti | 416/178 |
| 7,478,992 | B2 * | 1/2009 | Hsu et al. | 415/184 |
| 7,997,871 | B2 * | 8/2011 | Hwang et al. | 416/175 |

* cited by examiner

*Primary Examiner* — Igor Kershteyn
(74) *Attorney, Agent, or Firm* — Muncy, Geissler, Olds & Lowe, P.C.

(57) ABSTRACT

An impeller is provided. The impeller includes a hub, a plurality of upper blades, and a plurality of lower blades. The hub has an upper surface and a lower surface. The upper blades are disposed around the hub and connect to the upper surface. The lower blades are disposed around the hub and connect to the lower surface. The upper and lower blades are alternately disposed and outwardly extend from the hub.

25 Claims, 13 Drawing Sheets

IMPELLER

CROSS REFERENCE TO RELATED APPLICATIONS

This Application claims priority of Taiwan Patent Application No. 100205780, filed on Apr. 1, 2011, the entirety of which is incorporated by reference herein.

BACKGROUND OF THE INVENTION

1. Technical Field

The invention relates to an impeller, and more particularly, the invention relates to an impeller which has two kinds of alternate blades.

2. Description of the Related Art

In a conventional electrical system, since its internal electronic element is a large heat source, and the performance of the internal electronic element degrades with the increasing of the temperature thereof, the heat generated thereby has to be quickly removed so as to keep the internal electronic element's regular performance. Therefore, a fan generating airflow is commonly used to achieve the objective of rapidly dissipating heat.

Please refer to FIGS. 1 and 2. The conventional impeller 10 includes a hub 11 and a plurality of blades 12 circumferentially disposed around the hub 11. When the impeller 10 rotates along a rotating direction $R_1$, an air-pressure is produced by the blades 12 so as to generate airflow 13 for heat dissipation.

When the performance of an electronic element is enhanced, the heat generated by the electronic element is also greatly increased accordingly. For better heat dissipation, the rotational speed of the conventional fan has to be greatly increased. However, when the rotational speed of the impeller 10 is increased, an unpleasant noise gets louder due to turbulence airflow occurring between the blades 12.

Thus, it is a dilemma for a user. If the rotational speed is decreased, efficiency of heat dissipation degrades. If the rotational speed is increased, the noise produced by the fan becomes louder.

BRIEF SUMMARY OF THE INVENTION

In this regard, this invention provides an impeller with alternate blades, and noise produced by the impeller is remarkably reduced.

One of subjects of the invention is to provide an impeller, which includes a hub, a plurality of upper blades, and a plurality of lower blades. The hub has an upper surface and a lower surface. The upper blades are disposed around the hub and connect to the upper surface. The lower blades are disposed around the hub and connect to the lower surface. The upper and lower blades are alternately disposed and outwardly extend from the hub.

Through an arrangement of the upper and lower blades in which the upper blades and the lower blades are alternately and crowdedly disposed on the hub, turbulence airflow occurring between the blades is inhibited. Thus, noise, generated as the impeller rotates at a high speed, is reduced.

BRIEF DESCRIPTION OF THE DRAWINGS

The embodiment can be more fully understood by reading the subsequent detailed description and examples with references made to the accompanying drawings, wherein.

DETAILED DESCRIPTION OF THE INVENTION

Figure 1:
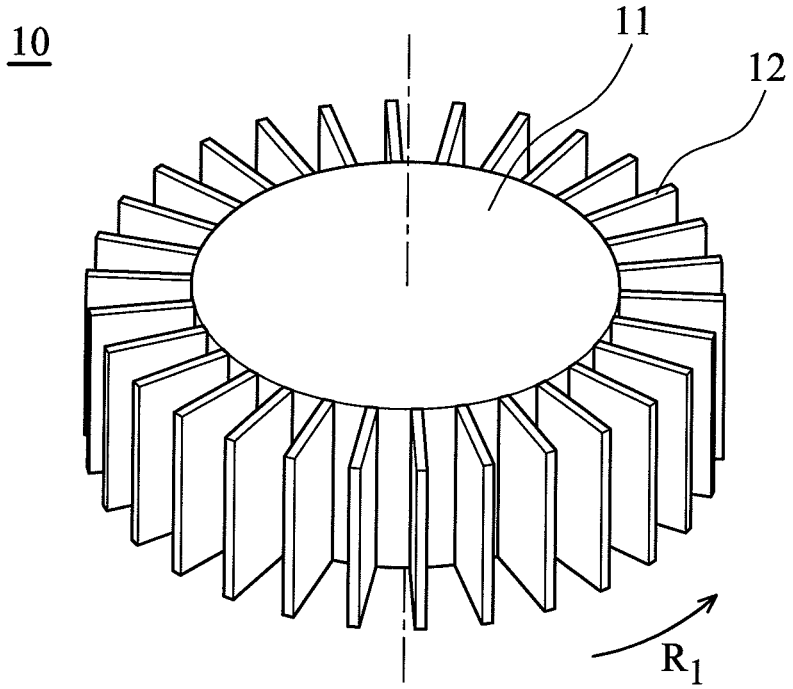
FIG. 1 illustrates a schematic view of a conventional centrifugal fan.
Figure 2:
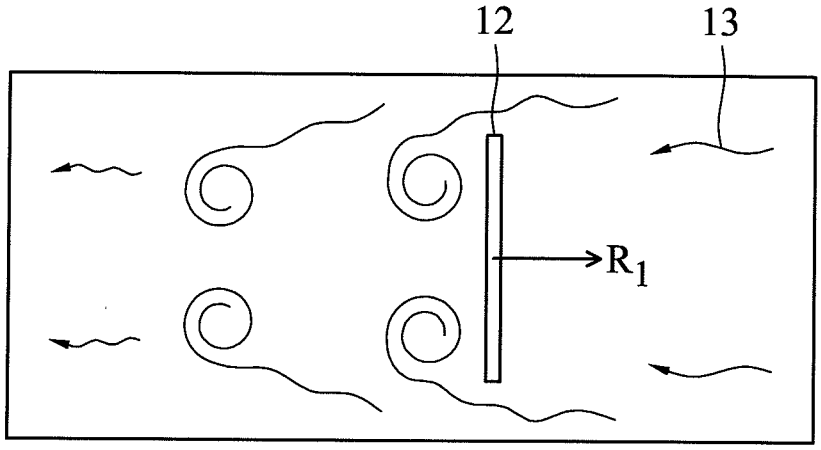
FIG. 2 illustrates turbulent flow as a result of rotation of the conventional centrifugal fan.
Figure 3A:
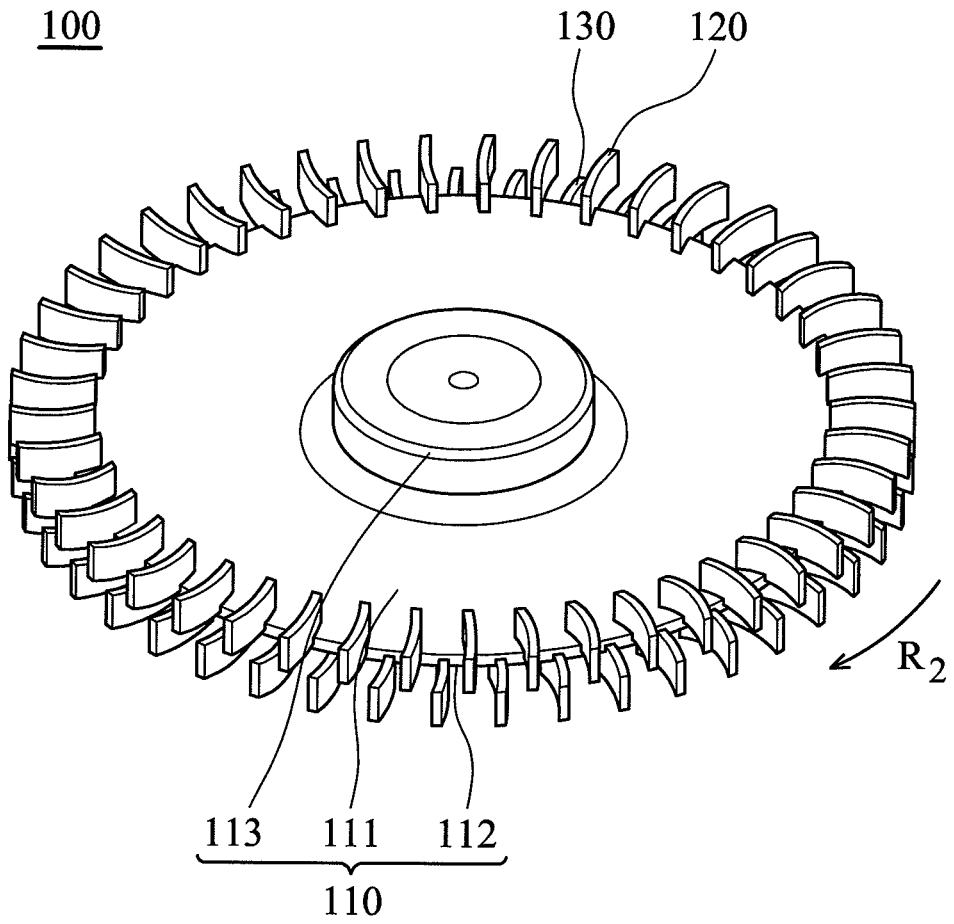
FIG. 3A illustrates a schematic view of the first embodiment of an impeller of the invention.
Figure 3B:
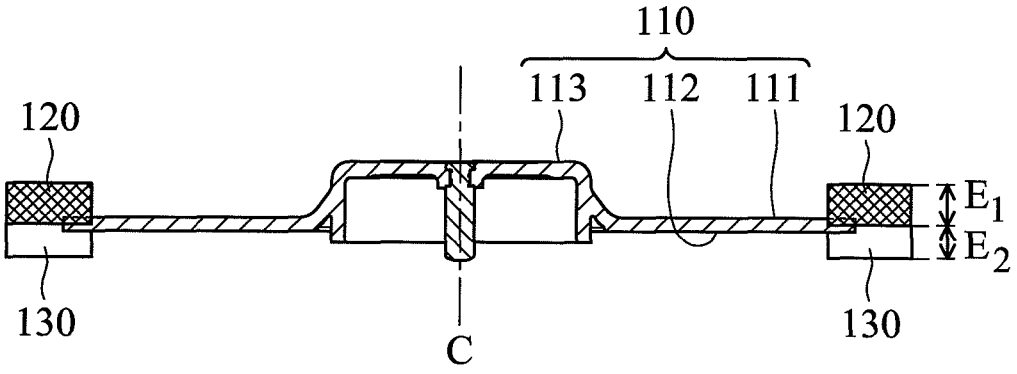
FIG. 3B illustrates a sectional view taken from FIG. 3A.
Figure 3C:
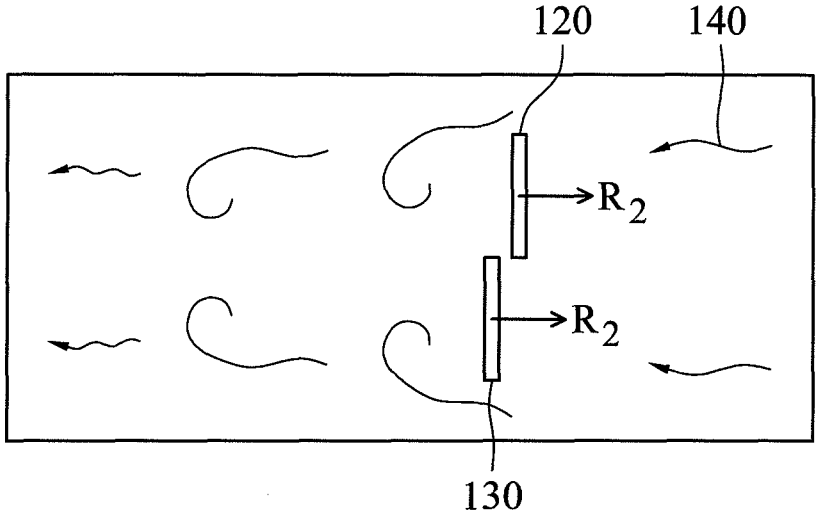
FIG. 3C illustrates turbulent flow as a result of rotation of the impeller of FIG. 3A.

Please refer to FIGS. 3A-3C. FIG. 3A illustrates a first embodiment of an impeller 100 of the invention. FIG. 3B illustrates a sectional view of the impeller 100. FIG. 3C illustrates a schematic view of partial structures of the invention, wherein only upper blades 120 and lower blades 130 and airflow 140 are shown in FIG. 3C.

The impeller 100 includes a hub 110, a plurality of upper blades 120, and a plurality of lower blades 130. The hub 110 has a circular shape and includes an upper surface 111 and a lower surface 112, wherein a protruded mounting part 113 is formed in a substantial central portion of the hub 110.

Each of the upper blades 120 is circumferentially disposed around the hub 110 and connects to the upper surface 111 of the hub 110. A fixed height is maintained from a proximal end to a distal end of each of the upper blades 120, and a cross sectional curvature of each of the upper blades 120 is not zero, wherein the term "cross sectional" is defined as a plane perpendicular to the axis C. Similarly, each of the lower blades 130 is circumferentially disposed around the hub 110 and connects to the lower surface 112 of the hub 110. It is noted that, the upper and lower blades 120 and 130 are alternately disposed on the hub 110. In this exemplary embodiment, the upper and lower blades 120 and 130 are alternately disposed and outwardly extend from the hub 110. In other words, along a direction parallel to the axis C, portions of the upper and lower blades 120 and 130 are not connected with the hub 110. Additionally, a height $E_1$ of the upper blades 120 is equal to a height $E_2$ of the lower blades 130, but it should not be limited thereto. In the other exemplary embodiment, the height $E_1$ may be greater or smaller than the height $E_2$.

Please refer to FIG. 3C. Due to a novel arrangement that the upper blades 120 and the lower blades 130 are alternately and crowdedly disposed on the hub 110, as the impeller 100 rotates along a rotating direction $R_2$, turbulent airflow 140 is exhibited. According to experiments, a noise reduction of 3-5 dB is achieved when the impeller 100 is operated at a high speed rotation.

Figure 4A:
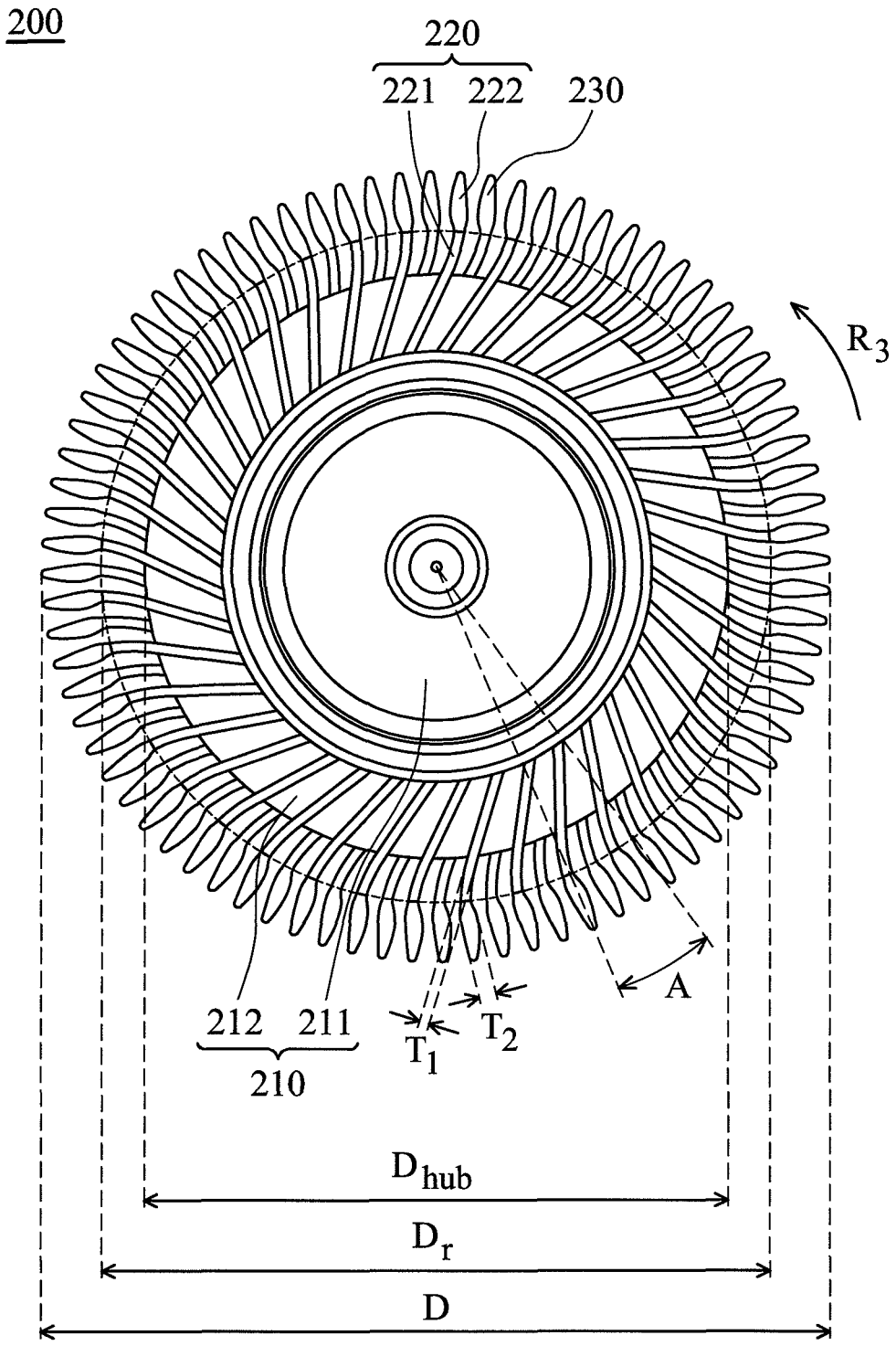
FIG. 4A illustrates a top view of the second embodiment of an impeller of the invention.
Figure 4B:
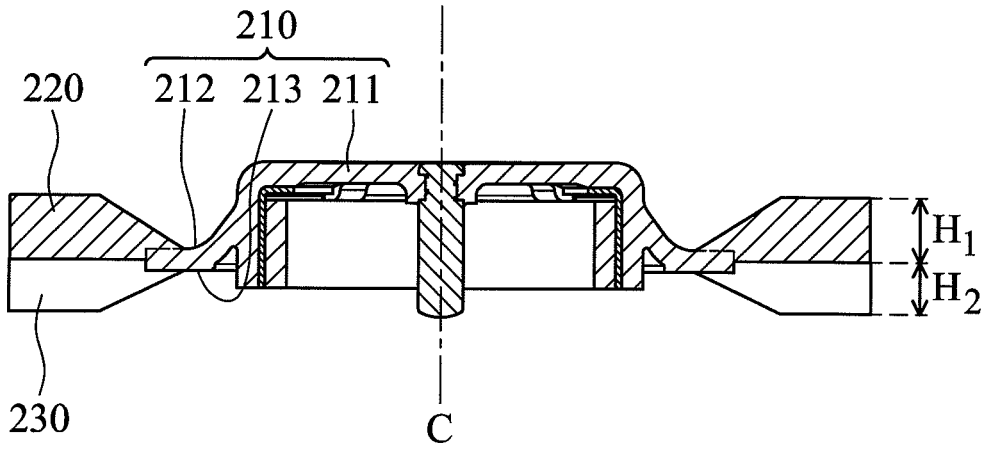
FIG. 4B illustrates a sectional view taken from FIG. 4A.
Figure 4C:
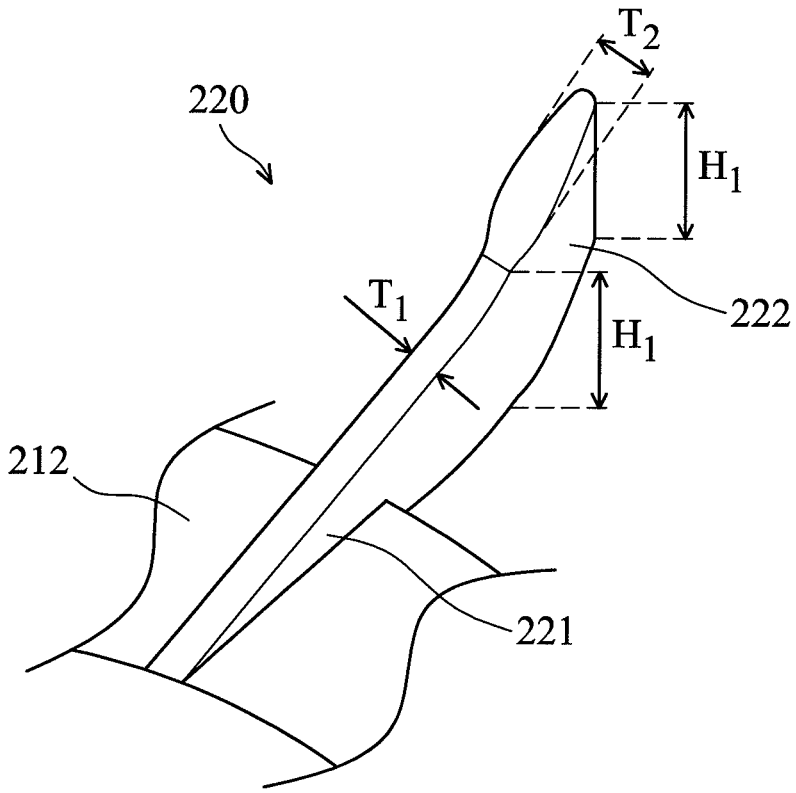
FIG. 4C illustrates a schematic view of partial structures of the impeller of FIG. 4A.
Figure 4D:
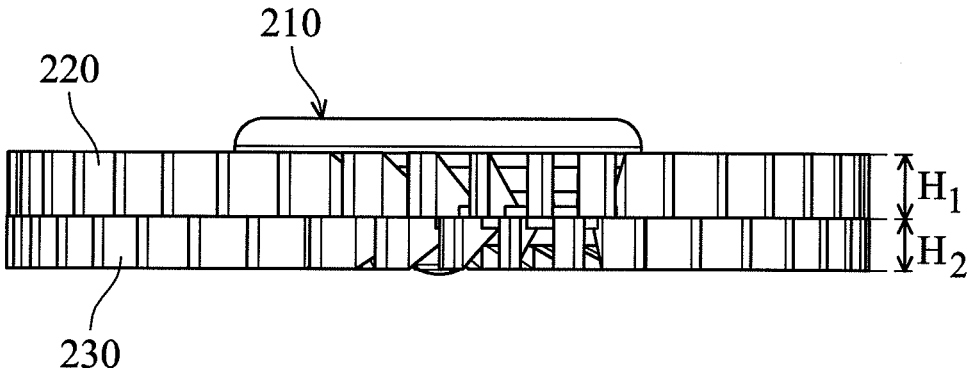
FIG. 4D illustrates a side view of the impeller of FIG. 4A.

Please refer to FIGS. 4A-4C. FIG. 4A illustrates a top view of a second embodiment of an impeller 200 of the invention. FIG. 4B illustrates a sectional view of the impeller 200 according to the second embodiment of the invention. FIG. 4C illustrates a schematic view of partial structures of the impeller 200, wherein for purpose of illustration, only an upper surface 212 of a hub 210 is shown.

The impeller 200 includes a hub 210, a plurality of upper blades 220, and a plurality of lower blades 230. The hub 210 has a circular shape and includes a protruded mounting part 211, an upper surface 212 and a lower surface 213, as shown in FIGS. 4A and 4B.

The upper blades 220 are circumferentially disposed around an axis C of the hub 210 and connect to the upper surface 212 of the hub 210. Each of the upper blades 220 has a first portion 221 and a second portion 222 coupled to the first portion 221, wherein the first portion 221 is defined as a portion that is close to the hub 210, and the second portion 222 is defined as a portion that is away from the hub 210. The first portion 211 has a first thickness $T_1$. Further, along the outwardly extended direction of the upper blades 220, the height of the first portion 221 is gradually increased to a height $H_1$. In addition, a cross section curvature of the first portion 221 is not always zero. That is, a curvature of the first portion 221 is not fixed.

The second portion 222 has the same height of the distal end of the first portion 211, height $H_1$, and the thickness of the second portion 222 is not fixed, such that an airfoil is formed at each second portion 222. Specifically, along the outwardly extended direction of the upper blades 220, the thickness of the second portions 212 gradually increases to the thickness $T_2$ and then gradually decreases. Furthermore, because the airfoil formed at the second portion 222 is protruded toward to a rotation direction $R_3$, a length of a windward side, a side that close to the rotation direction $R_3$, of each of the upper blades 220 is greater than a length of a leeward side, a side that away from the rotation direction $R_3$, of each of the upper blades 220.

In this exemplary embodiment, the first thickness $T_1$ is 0.5 mm, and the second thickness $T_2$ is 0.86 mm, but it is not limited thereto. The best molding techniques and material at the time of the invention can produce a blade with a thickness of 0.4 mm; thus, the ideal thickness of the upper blades 220 is between 0.4 mm and 1.2 mm. In this exemplary embodiment, the second thickness $T_2$ is greater than the first thickness $T_1$, wherein the second thickness $T_2$ is 1-3 times that of the first thickness $T_1$. Preferably, the second thickness $T_2$ is 1-2.5 times that of the first thickness $T_1$.

Please refer to FIG. 4A. The distal ends of the first portions 221 of each of the upper blades 220 form a reference circle from a top view, and the reference circle has a radius $D_r$. The radius $D_r$ of the reference circle is 0.75-0.95 times that of a radius D of the impeller 200. Preferably, the radius $D_r$ of the reference circle is 0.8-0.9 times that of the radius D of the impeller 200. Additionally, the radius $D_r$ is between a radius $D_{hub}$ of the hub 210 and the radius D of the impeller 200.

Because the cross section curvature of the first portion 221 is not zero, an angle A, as shown in FIG. 4A, is formed, wherein the angle A is formed, from a top view, from the axis C to the distal end of the second portion 222 of one of the upper blades 220, and the axis C to the proximal end of the first portion 221 of the same upper blade 220. In this exemplary embodiment, the angle A is 11°, but it is note limited thereto. The angle A may be 0-60°, and the angle A is preferably 0-30°.

Please refer to FIGS. 4A-4C and FIG. 4D. The lower blades 230 have the same structure as the upper blades 220. The lower blades 230 are circumferentially disposed around the hub 210 and connect to the lower surface 213 of the hub 210, wherein the distal ends of each of the lower blades 230 has a height $H_2$. In this exemplary embodiment, the upper and lower blades 220 and 230 are alternately disposed and outwardly extend from the hub 210. Furthermore, in this exemplary embodiment, a height $H_1$ of the upper blades 220 is greater than a height $H_2$ of the lower blades 230, but it should not be limited thereto, as the height $H_1$ can be designed with a height that is smaller or equal to the height $H_2$.

Figure 5:
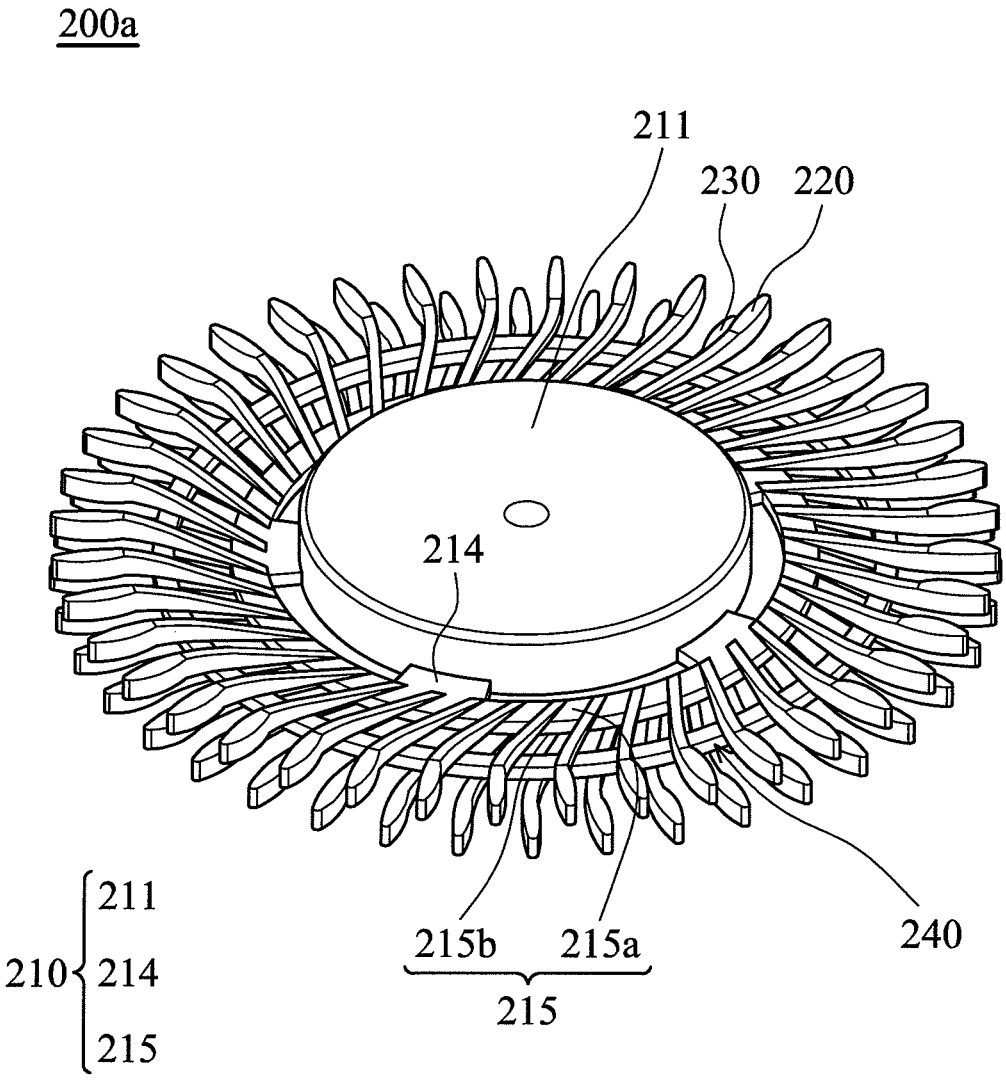
FIG. 5 illustrates a schematic view of the third embodiment of an impeller of the invention.

Please refer to FIG. 5. FIG. 5 illustrates a third embodiment of the impeller 200*a* of the invention. The impeller 200*a* is similar to the impeller 200, but, the differences are that the impeller 200*a* further includes a first circular ring 240, and the hub 210 further includes a plurality of ribs 214 and a second circular ring 215 disposed around the hub 210. The first circular ring 240 is disposed between the upper blades 220 and the lower blades 230, for enhanced structural strength between the upper and lower blades 220 and 230. The ribs 214 are disposed on the outer sidewall of the mounting part 211 and radially extended. The second circular ring 215 is connected to the distal ends of each of the ribs 214. The second circular ring 215 has an upper surface 215*a* and a lower surface 215*b*, wherein the upper blades 220 are disposed around the hub 210 and connect to the upper surface 215*a*, and the lower blades 230 are disposed around the hub 210 and connect to the lower surface 215*b*. The upper blades 220 and the lower blades 230 are alternately disposed and outwardly extend from the mounting part 211 of the hub 210. When fabricating, the hub 210, the upper blades 220, the lower blades 230, and the first circular ring 240 are formed integrally.

Structures of the upper and lower blades of the invention should not be limited by the above description. A variety of different forms of the blades will be described in the following description. For simplification, the interconnecting relationship between the blades and the hub is omitted, and descriptions of structures of lower blades of the following embodiment are omitted because the lower blades are identical with the upper blades.

Figure 6A:
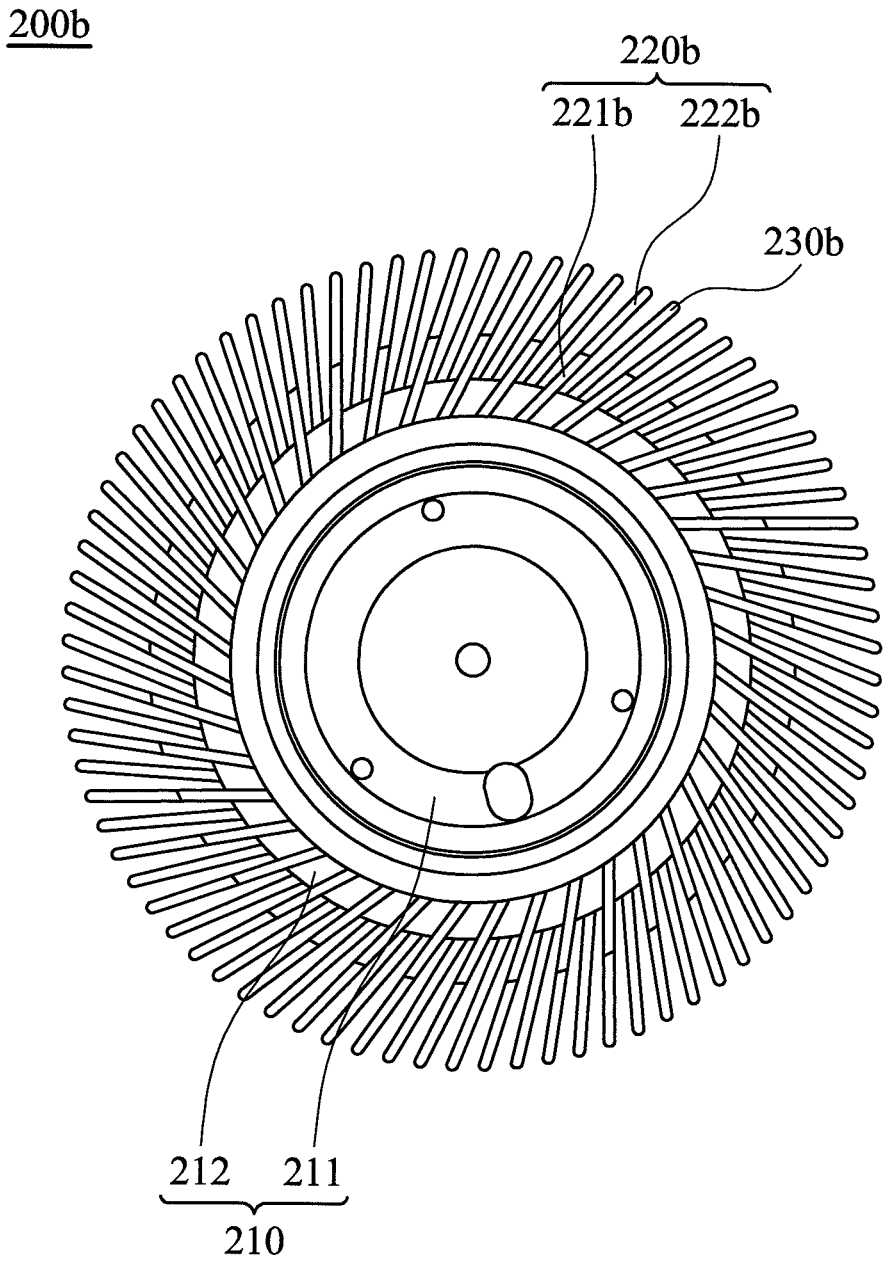
FIG. 6A illustrates a top view of the fourth embodiment of an impeller of the invention.
Figure 6B:
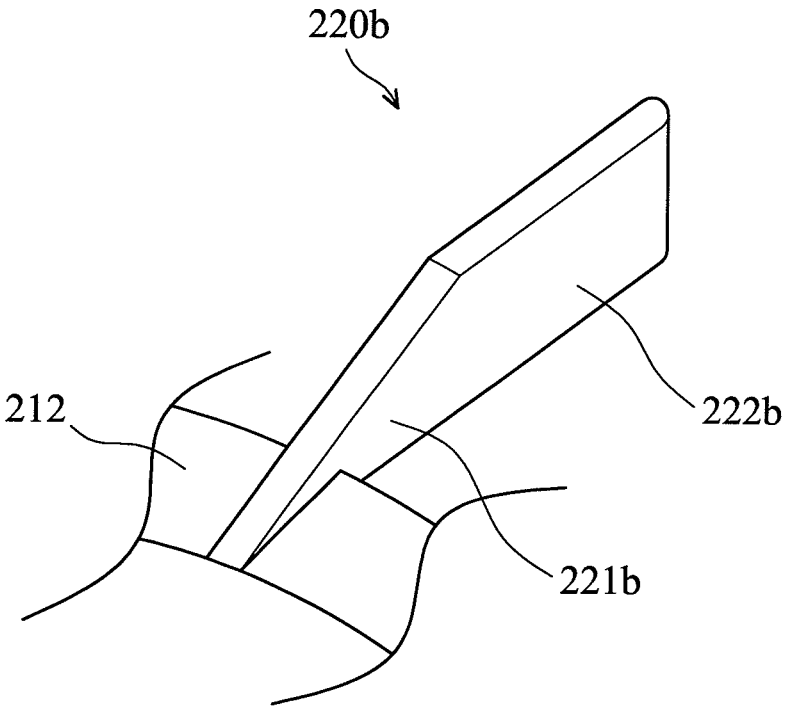
FIG. 6B illustrates a schematic view of partial structures of the impeller of FIG. 6A.

Please refer to FIGS. 6A and 6B. FIG. 6A illustrates a top view of an impeller 200*b*, and FIG. 6B illustrates a schematic view of partial structures of the impeller 200*b*. To present structural features of upper blades 220*b* clearly, only an upper surface 212 of a hub 210 is illustrated. Each of the upper blades 220*b* has a first portion 221*b* and a second portion 222*b* coupled to a distal end of the first portion 221*b*. Along the extended direction of the upper blades 220*b*, the height of the first portion 221*b* is gradually increased. With the same height of the distal end of the first portion 221*b*, the second portion 222*b* extends outwardly. In this exemplary embodiment, the upper blade 220*b* extends along a radial direction with the same curvature.

Figure 7A:
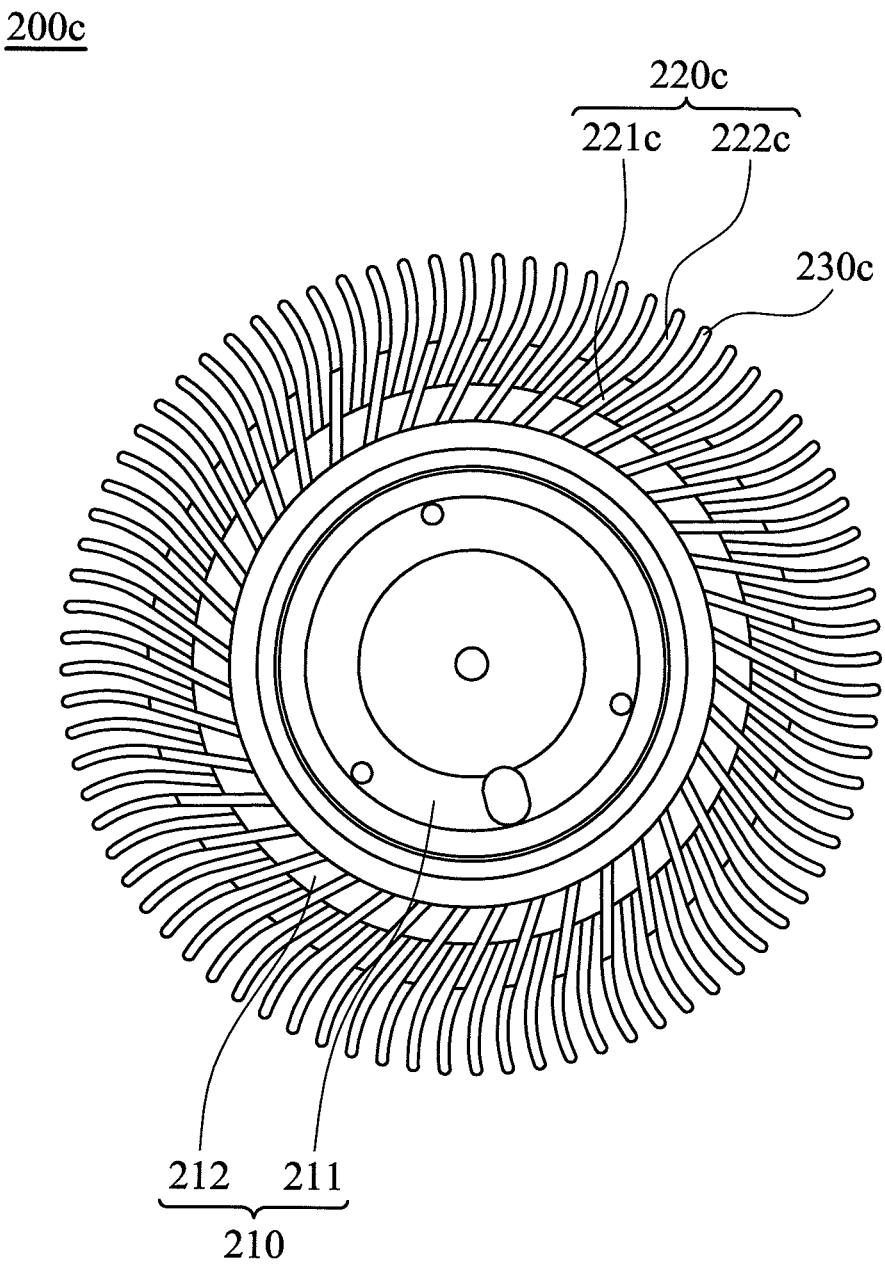
FIG. 7A illustrates a top view of the fifth embodiment of an impeller of the invention.
Figure 7B:
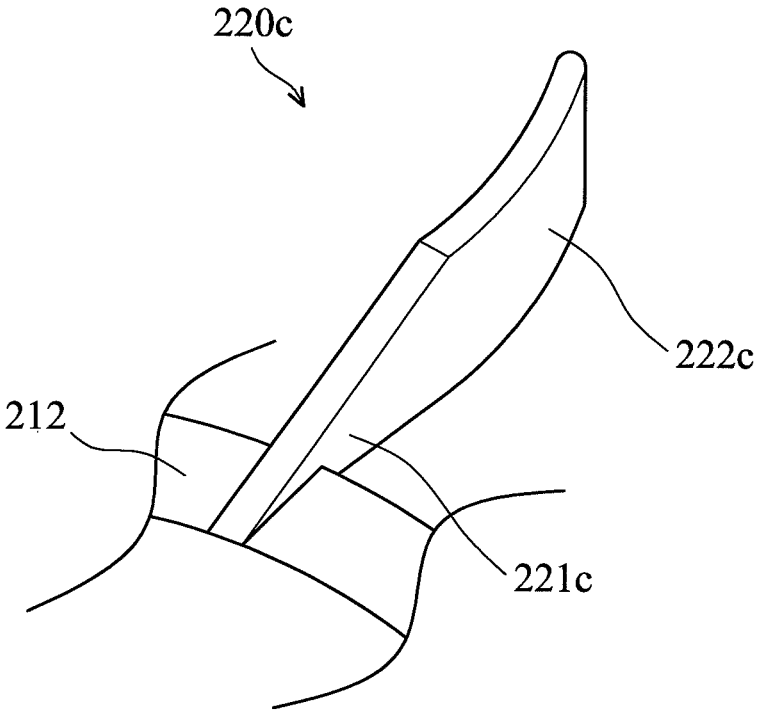
FIG. 7B illustrates a schematic view of partial structures of the impeller of FIG. 7A.

Please refer to FIGS. 7A and 7B. FIG. 7A illustrates the top view of an impeller 200*c*, and FIG. 7B illustrates a schematic view of partial structures of the impeller 200*c*. To present structural features of upper blades 220*c* clearly, only an upper surface 212 of the hub 210 is illustrated. The difference between the impeller 200*b* and the impeller 200*c* is that a cross sectional curvature of a second portion 222*c* of each of the upper blades 220*c* is not zero.

Figure 8A:
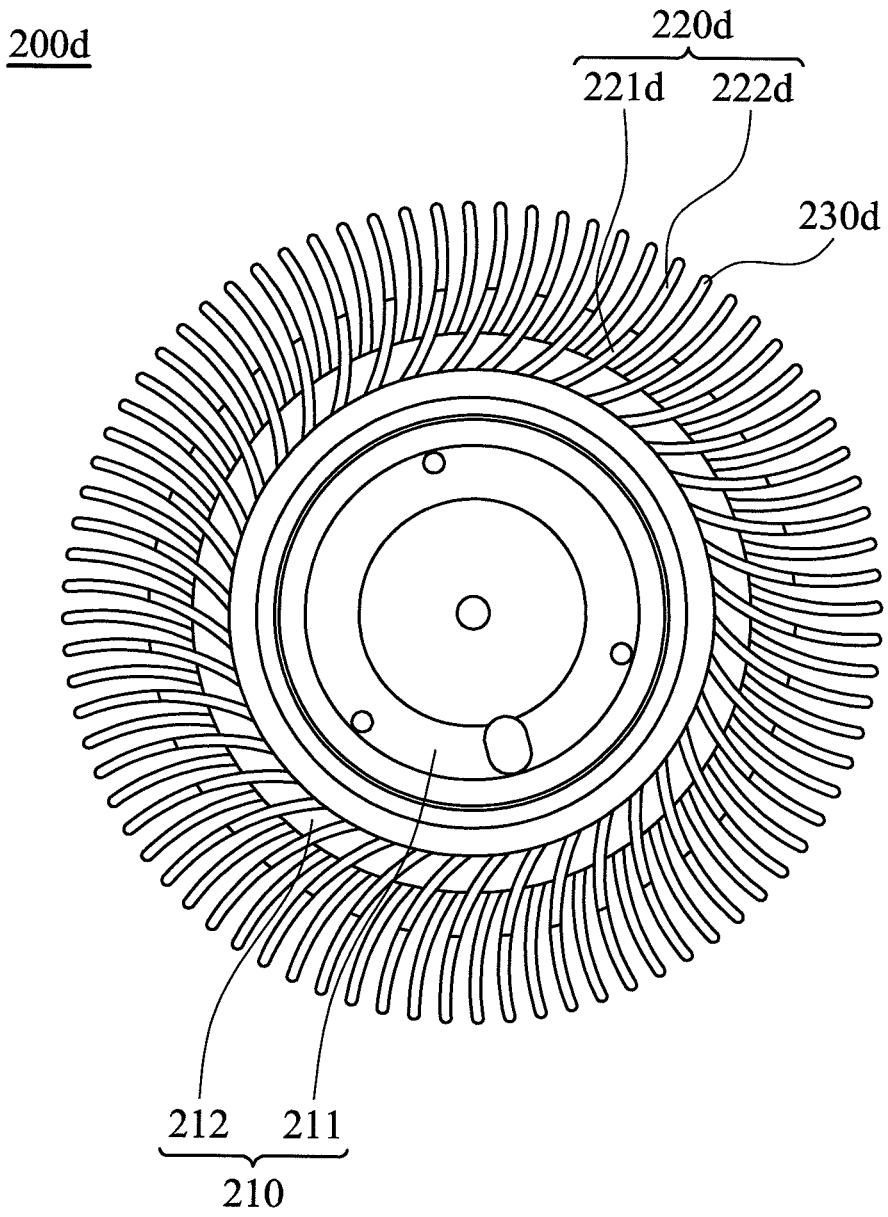
FIG. 8A illustrates a top view of the sixth embodiment of an impeller of the invention.
Figure 8B:
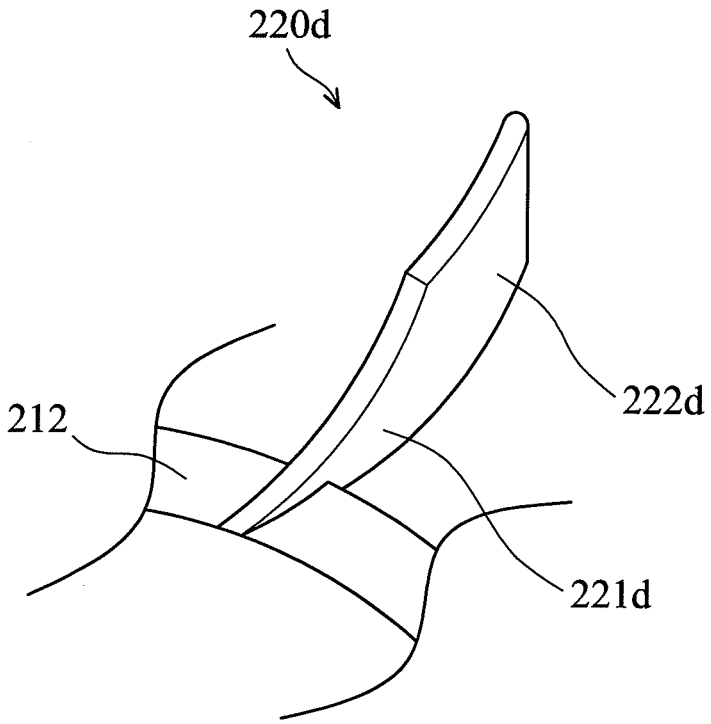
FIG. 8B illustrates a schematic view of partial structures of the impeller of FIG. 8A.

Please refer to FIGS. 8A and 8B. FIG. 8A illustrates the top view of an impeller 200*d*, and FIG. 8B illustrates a schematic view of partial structures of the impeller 200*d*. To present structural features of upper blades 220*d* clearly, only an upper surface 212 of the hub 210 is shown. The difference between the impeller 200*d* and the impeller 200*b* is that cross sectional curvatures of a first portion 221*d* and a second portion 222*d* of each of the upper blades 220*d* are not zero.

As reflected above, it is thanks to the novel structure, wherein the upper and lower blades alternately and crowdedly connected to the hub, that when the impeller rotates, the turbulent airflow is exhibited, so that the problem where unpleasant noise is generated by the conventional fans is eliminated.

While the embodiment has been described by way of example and in terms of the embodiments, it is to be understood that the embodiment is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An impeller, comprising:
- a hub having an upper surface and a lower surface;
- a plurality of upper blades disposed around the hub and connected to the upper surface; and
- a plurality of lower blades disposed around the hub and connected to the lower surface,
- wherein the upper and lower blades are alternately disposed and outwardly extend from the hub,
- wherein the height of the upper and lower blades, along the extended direction, are gradually increased,
- wherein a cross sectional curvature of each of the upper and lower blades is not zero, and
- wherein the hub has an axis, and an angle, from a top view, formed from the axis to the distal ends of each of the upper or lower blades, respectively, and the axis to the a proximal end of each of the upper or lower blades respectively is 0-60°.

2. The impeller as claimed in claim 1, wherein the angle is 0-30°.

3. The impeller as claimed in claim 1, wherein each of the upper and lower blades has a first portion and a second portion, and the first portion has a first thickness, and the second portion, with an airfoil, has a second thickness, wherein the second thickness is greater than the first thickness.

4. The impeller as claimed in claim 3, wherein the second thickness is 1-3 times that of the first thickness.

5. The impeller as claimed in claim 4, wherein the second thickness is 1-2.5 times that of the first thickness.

6. The impeller as claimed in claim 3, wherein a length of a windward side of each of the upper and lower blades is greater than a length of a leeward side of each of the upper and lower blades.

7. The impeller as claimed in claim 3, wherein the distal ends of the first portions of each of the upper and lower blades form a reference circle from a top view, and a radius of the reference circle is 0.75-0.95 times that of a radius of the hub.

8. The impeller as claimed in claim 7, wherein the radius of the reference circle is 0.8-0.9 times that of the radius of the hub.

9. The impeller as claimed in claim 1, wherein a height of the upper blades is different from a height of the lower blades.

10. The impeller as claimed in claim 1, wherein each of the upper and lower blades has a thickness, and the thickness is between 0.4 mm and 1.2 mm.

11. An impeller, comprising:
- a hub having an upper surface and a lower surface;
- a plurality of upper blades disposed around the hub and connected to the upper surface; and
- a plurality of lower blades disposed around the hub and connected to the lower surface,
- wherein the upper and lower blades are alternately disposed and outwardly extend from the hub, and the cross sectional curvature near to distal ends of each of the upper and lower blades is not zero.

12. The impeller as claimed in claim 11, wherein a height of the upper blades is different from a height of the lower blades.

13. The impeller as claimed in claim 11, wherein each of the upper and lower blades has a thickness, and the thickness is between 0.4 mm and 1.2 mm.

14. An impeller, comprising:
- a hub having an upper surface and a lower surface;
- a plurality of upper blades disposed around the hub and connected to the upper surface;
- a plurality of lower blades disposed around the hub and connected to the lower surface; and
- a first circular ring disposed between the upper and lower blades,
- wherein the upper and lower blades are alternately disposed and outwardly extend from the hub.

15. The impeller as claimed in claim 14, wherein a height of the upper blades is different from a height of the lower blades.

16. The impeller as claimed in claim 14, wherein each of the upper and lower blades has a thickness, and the thickness is between 0.4 mm and 1.2 mm.

17. The impeller as claimed in claim 14, further comprises a second circular ring disposed around the hub, and the upper and lower blades are connected to the second circular ring.

18. The impeller as claimed in claim 14, wherein the hub, the first circular ring and the upper and lower blades are formed integrally as one piece.

19. An impeller, comprising:
- a hub having an upper surface and a lower surface;
- a plurality of upper blades disposed around the hub and connected to the upper surface; and
- a plurality of lower blades disposed around the hub and connected to the lower surface,
- wherein the upper and lower blades are alternately disposed and outwardly extend from the hub,
- wherein the hub has an axis, and an angle, from a top view, formed from the axis to the distal ends of each of the upper or lower blades, respectively, and the axis to the a proximal end of each of the upper or lower blades, respectively, is 0-60°.

20. The impeller as claimed in claim 19, wherein each of the upper and lower blades has a first portion and a second portion, and the first portion has a first thickness, and the second portion, with an airfoil, has a second thickness, wherein the second thickness is greater than the first thickness.

21. The impeller as claimed in claim 20, wherein the second thickness is 1-3 times that of the first thickness.

22. The impeller as claimed in claim 21, wherein the second thickness is 1-2.5 times that of the first thickness.

23. The impeller as claimed in claim 20, wherein a length of a windward side of each of the upper and lower blades is greater than a length of a leeward side of each of the upper and lower blades.

24. The impeller as claimed in claim 20, wherein the distal ends of the first portions of each of the upper and lower blades form a reference circle from a top view, and a radius of the reference circle is 0.75-0.95 times that of a radius of the hub.

25. The impeller as claimed in claim 24, wherein the radius of the reference circle is 0.8-0.9 times that of the radius of the hub.

* * * * *